US012000093B2

(12) United States Patent
Lintz

(10) Patent No.: US 12,000,093 B2
(45) Date of Patent: Jun. 4, 2024

(54) BALLAST SWEEPING INSTALLATION FOR PICKING UP AND DISTRIBUTING BALLAST LOCATED ON A TRACK

(71) Applicant: PLASSER & THEURER EXPORT VON BAHNBAUMASCHINEN GESELLSCHAFT M.B.H., Vienna (AT)

(72) Inventor: Gerard Lintz, Bening-les-Saint-Avold (FR)

(73) Assignee: Plasser & Theurer Export von Bahnhaumaschinen Gesellschaft m.b.H., Vienna (AT)

( * ) Notice: Subject to any disclaimer, the term of this patent is extended or adjusted under 35 U.S.C. 154(b) by 1586 days.

(21) Appl. No.: 16/301,107

(22) PCT Filed: Apr. 24, 2017

(86) PCT No.: PCT/EP2017/000504
§ 371 (c)(1),
(2) Date: Nov. 13, 2018

(87) PCT Pub. No.: WO2017/202483
PCT Pub. Date: Nov. 30, 2017

(65) Prior Publication Data

US 2019/0194877 A1 Jun. 27, 2019

(30) Foreign Application Priority Data

May 23, 2016 (AT) ..... A 258/2016

(51) Int. Cl.
*E01B 27/02* (2006.01)

(52) U.S. Cl.
CPC ..... *E01B 27/026* (2013.01); *E01B 2203/027* (2013.01)

(58) Field of Classification Search
CPC ..... E01B 27/026; E01B 2203/027
See application file for complete search history.

(56) References Cited

U.S. PATENT DOCUMENTS 1,468,528 A * 9/1923 Vena ..... E01B 27/021 37/104
2,869,159 A * 1/1959 Kershaw ..... E01B 27/026 15/55

(Continued)

FOREIGN PATENT DOCUMENTS

AT 506078 A4 * 6/2009 ..... E01B 27/022
DE 9110231 U1 9/1992

(Continued)

*Primary Examiner* — Scott A Browne
(74) *Attorney, Agent, or Firm* — Laurence A. Greenberg; Werner H. Stemer; Ralph E. Locher

(57) ABSTRACT

A ballast sweeping installation for picking up and distributing ballast located on a track includes a sweeping brush rotatable about an axis of rotation, a ballast conveyor belt disposed ahead of the sweeping brush relative to a brush rotation direction, and a ballast guiding plate positioned between the sweeping brush and the ballast conveyor belt for passing the ballast on to the ballast conveyor belt. A length of the ballast conveyor belt delimited by two deflection ends is shorter than a length of the sweeping brush along the axis of rotation. Additionally, the ballast conveyor belt is configured to be displaceable in a transport direction relative to the sweeping brush by a drive. Thus, an optimal ballast distribution in tamping zones of the track is made possible.

4 Claims, 2 Drawing Sheets

(56) References Cited

U.S. PATENT DOCUMENTS

| | | | | | |
|---|---|---|---|---|---|
| 4,554,697 | A | * | 11/1985 | Coy | E01B 27/026 15/55 |
| 5,097,608 | A | * | 3/1992 | Theurer | E01B 27/026 37/104 |

FOREIGN PATENT DOCUMENTS

| | | | | |
|---|---|---|---|---|
| EP | 0428781 | A1 | * | 5/1991 |
| EP | 1310597 | A2 | | 5/2003 |
| EP | 2250318 | B1 | | 3/2012 |
| GB | 2211228 | A | | 6/1989 |
| WO | 2013189564 | A1 | | 12/2013 |

* cited by examiner

BALLAST SWEEPING INSTALLATION FOR PICKING UP AND DISTRIBUTING BALLAST LOCATED ON A TRACK

BACKGROUND OF THE INVENTION

Field of the Invention

The invention relates to a ballast sweeping installation for picking up and distributing ballast located on a track, consisting of a sweeping brush rotatable about an axis of rotation, a ballast conveyor belt arranged in front of the same with regard to a brush rotation direction and having a transport direction extending parallel to the axis of rotation, and with a ballast guiding plate positioned between the sweeping brush and ballast conveyor belt for passing the ballast on to the ballast conveyor belt.

Ballast sweeping installations of this kind are often used in connection with a ballast plough and are known, for instance, from DE 911 02 31 U1 or EP 2 250 318. In this, excess ballast is swept from the track and fed to a conveyor belt for discharge in the shoulder area of the track.

Also known, according to WO 2013/189564, is a ballast plough having a ballast silo for intermediate storage of large quantities of ballast. If the ballast silo is full, the same can be discharged into the shoulder area of the track by means of a transversely displaceable conveyor belt.

SUMMARY OF THE INVENTION

It is the object of the present invention to provide a ballast sweeping installation of the type mentioned at the beginning with which an improved ballast distribution is possible.

According to the invention, this object is achieved with a ballast sweeping installation of the specified kind in that a length of the ballast conveyor belt delimited by two deflection ends is designed to be shorter than a length of the sweeping brush extending in the axis of rotation, and that the ballast conveyor belt is designed to be displaceable in the transport direction by means of a drive.

With this special design of the ballast conveyor belt, it is now possible in an advantageous manner to discharge excess ballast, picked up by the sweeping brush, in a targeted manner into the tamping zones of the track as needed in order to ultimately enable a qualitatively uniform tamping. Consequently, a heretofore customary disposal of the excess ballast into the shoulder area and a resulting uneconomical ballast accumulation becomes unnecessary.

Additional advantages of the invention become apparent from the dependent claims and the drawing description.

The invention will be described in more detail below with reference to an embodiment represented in the drawing.

DESCRIPTION OF THE INVENTION

Figure 1:
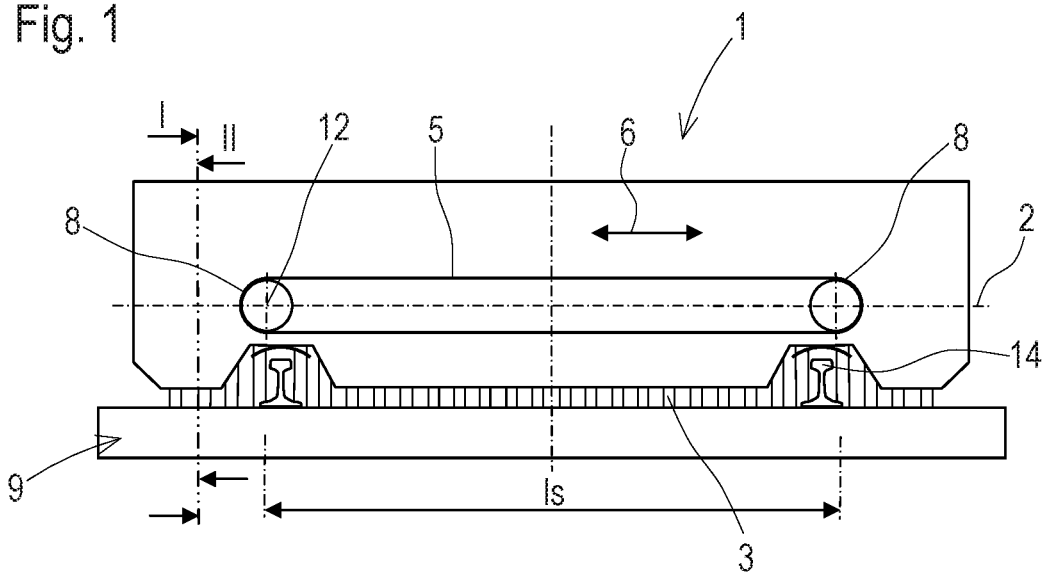
FIG. 1 shows a view of a ballast sweeping installation in a longitudinal direction of the track, FIGS. 2 and 3 each show a cross-section of the ballast sweeping installation.
Figure 2:
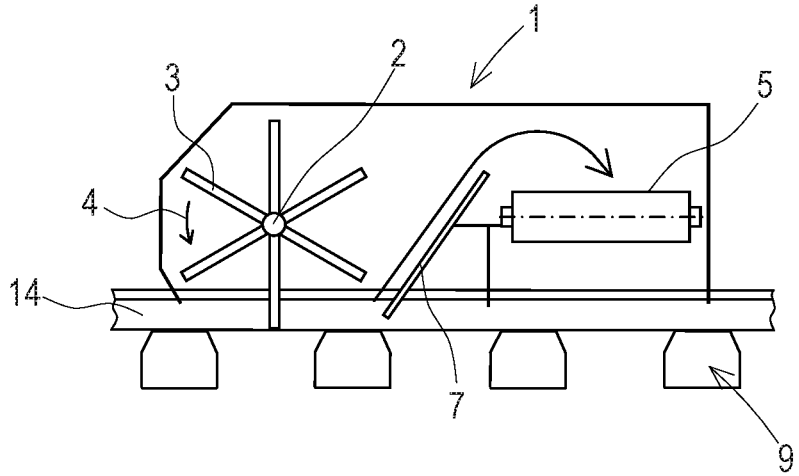
Figure 3:
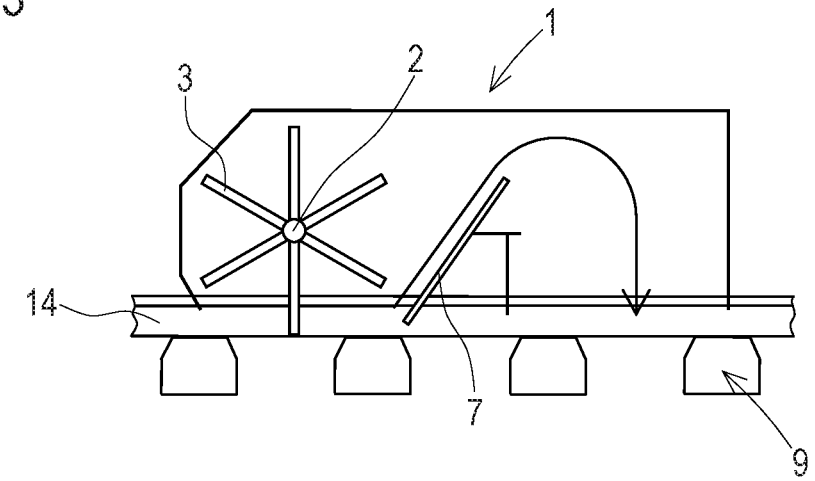

A ballast sweeping installation 1, represented in FIGS. 1 to 5, for picking up and distributing ballast located on a track consists of a sweeping brush 3 rotatable about an axis of rotation 2, and a ballast conveyor belt 5 arranged ahead of the same with regard to a brush rotation direction 4 and having a transport direction 6 extending parallel to the axis of rotation 2. Located between the sweeping brush 3 and the ballast conveyor belt 5 is a ballast guiding plate 7, arranged inclined, for passing the ballast captured by the sweeping brush 3 on to the ballast conveyor belt 5.

A length $l_S$ of the ballast conveyor belt 5 delimited by two deflection ends 8 is designed to be shorter than a length $l_K$ of the sweeping brush 3 extending in the axis of rotation 2. Preferably, the length $l_S$ of the ballast conveyor belt 5 is designed to correspond approximately to a gauge of a track 9 to be swept off.

The ballast conveyor belt 5 is designed to be displaceable by means of a drive 10 in the transport direction 6 relative to the sweeping brush 3 and parallel to the axis of rotation 2 in both directions. Preferably, the displacement path is dimensioned in such a way that each deflection end 8 is movable in each case from the position visible in FIG. 1 to a closer positioned adjoining end of the sweeping brush 3. With the aid of a reversible rotation drive 12, the ballast can be shifted selectively to one or the other deflection end 8 by reversing the transport direction 6.

Arranged underneath the ballast conveyor belt 5 are two cover plates 13—spaced from one another in the transport direction 6 at a distance corresponding to the gauge of the track 9—for avoiding any ballast discharge upon rails 14 of the track 9. The tamping zones 15 which are essential for a tamping of the track 9 are located adjoining both longitudinal sides of the rail 14.

Figure 4:
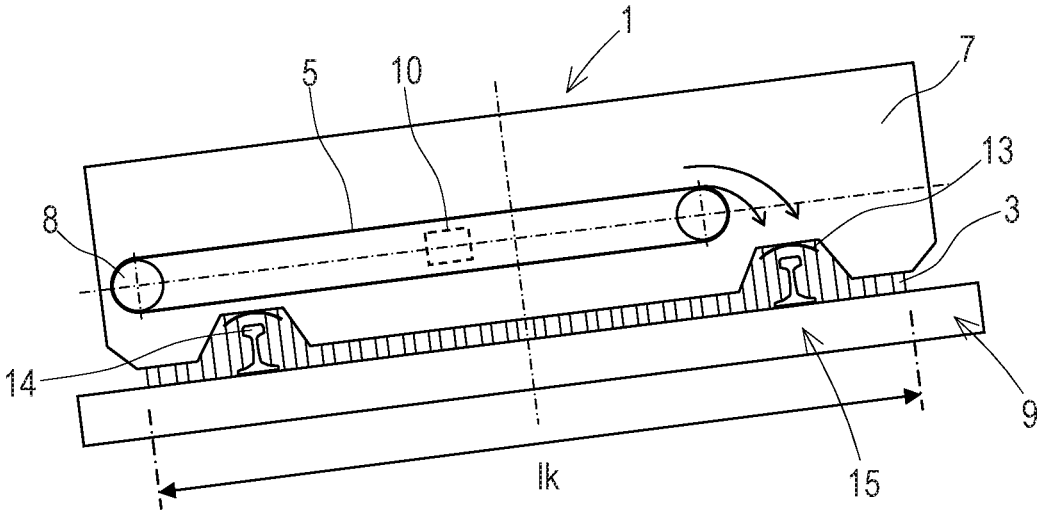
FIG. 4 shows a maximum displacement of a ballast conveyor belt.

Due to the displaceability of the ballast conveyor belt 5, it is possible, for example—in the case of an adjacent track to the left as seen in the track direction in FIG. 4—by maximum displacement towards the neighbouring track to discharge ballast collected by the sweeping brush 3 into the tamping zones 15 of the rail 14 spaced farther from the neighbouring track. This is advantageous particularly if, in the case of a transverse track inclination (see FIG. 4), said rail 14 is positioned higher. In this situation there is often the problem that, in the region of the higher positioned rail, too little ballast is present for an optimal tamping.

However, it is advantageously also possible in the central basic position of the ballast conveyor belt 5 visible in FIG. 1 to discharge ballast as needed into the tamping zone of the left or right rail 14 by rapid reversal of the transport direction 6.

Figure 5:
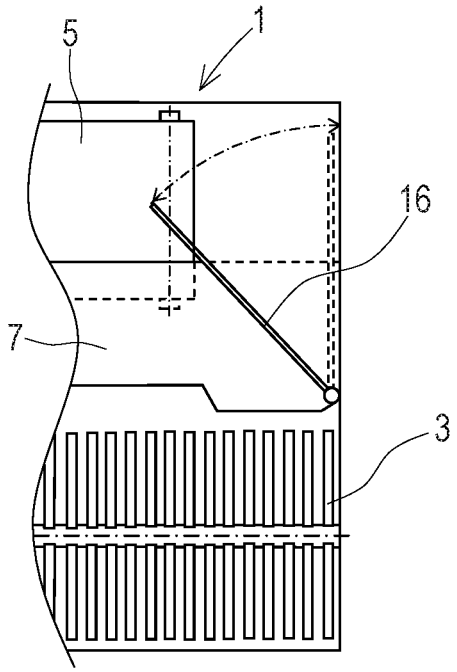
FIG. 5 shows a simplified top view of an alternative embodiment of the ballast sweeping installation.

As can be seen in FIG. 5, as alternative auxiliary equipment a deflection plate 16 is provided in each case at an end region of the ballast guiding plate 7. Said deflection plate 16 is connected to the ballast guiding plate 7 and pivotable about a pivot axis extending perpendicularly to a plane of the ballast guiding plate 7 from a position represented in a dashed line into a deflection position represented in a full line. In this position, the ballast is deflected for deposit to the ballast conveyor belt 5 if the latter is situated in the maximum left-hand position shown in FIG. 4.

The invention claimed is:

1. A ballast sweeping installation for picking up and distributing ballast located on a track, the ballast sweeping installation comprising:

a sweeping brush being rotatable about an axis of rotation in a brush rotation direction, said sweeping brush having length along said axis of rotation;

a ballast conveyor belt disposed ahead of said sweeping brush relative to said brush rotation direction, said ballast conveyor belt having a transport direction extending parallel to said axis of rotation;

said ballast conveyor belt having two deflection ends and having a length delimited by said two deflection ends being shorter than said length of said sweeping brush, said length of said ballast conveyor belt corresponding approximately to a gauge of the track;

said ballast conveyor belt and said deflection ends being moveable parallel to said axis of rotation of said sweeping brush;

a drive for displacing said ballast conveyor belt in said transport direction relative to said sweeping brush; and a ballast guiding plate positioned between said sweeping brush and said ballast conveyor belt for passing the ballast on to said ballast conveyor belt.

2. The ballast sweeping installation according to claim 1, wherein said drive is configured for selectively reversing a displacement direction of said ballast conveyor belt extending parallel to said axis of rotation.

3. The ballast sweeping installation according to claim 1, which further comprises a rotation drive configured for reversing said transport direction of said ballast conveyor belt.

4. The ballast sweeping installation according to claim 1, which further comprises two cover plates disposed underneath said ballast conveyor belt for avoiding any ballast discharge upon rails of the track, said two cover plates being spaced apart from one another in said transport direction at a distance corresponding to a gauge of the track.

* * * * *